United States Patent [19]

Willis et al.

[11] Patent Number: 4,821,814

[45] Date of Patent: Apr. 18, 1989

[54] TOP HEAD DRIVE ASSEMBLY FOR EARTH DRILLING MACHINE AND COMPONENTS THEREOF

[75] Inventors: Clyde A. Willis; Keith M. Haney, both of Wichita Falls, Tex.

[73] Assignee: 501 W-N Apache Corporation, Wichita Falls, Tex.

[21] Appl. No.: 35,021

[22] Filed: Apr. 2, 1987

[51] Int. Cl.[4] ..... E21B 19/16

[52] U.S. Cl. ..... 173/164; 175/423; 81/57.33

[58] Field of Search ..... 173/164; 175/52, 85, 175/422 WS, 423; 414/745; 81/57.33-57.35

[56] References Cited

U.S. PATENT DOCUMENTS

| | | | |
|---|---|---|---|
| 3,126,063 | 3/1964 | Pitt et al. | 173/164 |
| 3,312,294 | 4/1967 | Wilson | 173/164 |
| 3,949,818 | 4/1976 | Russell | 175/52 |
| 4,147,215 | 4/1979 | Hodge et al. | 173/164 |
| 4,403,666 | 9/1983 | Willis | 173/164 |
| 4,438,984 | 3/1984 | Leppala | 175/85 |

OTHER PUBLICATIONS

Power Swivel Bretfor 500, Alsthom acb, Prairie au Duc, Nantes Cedex, France Brochure No. 466H.

Varco Top Drive Drilling System Description and Specifications, Technical Bulletin, Revision F, May 1985, pp. 1-58, Varco International, Inc.

Varco International, Inc., Top Drive Drilling System, July 1986.

BJ Oil Field Products and Systems-Power Swivel Drilling System, Hughes Drilling Equipment, BJ Products, pp. 1-1 through 5-3.

Varco "Top Drive Drilling System", pp. 6403-6404 and 3-4.

The BJ Power Swivel For More Effective Drilling and Pipe Handling from Hughes Drilling Equipment.

BJ Power Pipe Handling Systems, pp. 2841-2842 and 7-8.

Maritime Hydraulics A-S, Power Swivel "DDM-650" Derrick Drilling Machine.

Cavins "Advance" Spider Model F and G, p. 1251.

*Primary Examiner*—Frank T. Yost

*Assistant Examiner*—James L. Wolfe

*Attorney, Agent, or Firm*—Willian Brinks Olds Hofer Gilson & Lione Ltd.

[57] ABSTRACT

A top head drive assembly for a drilling machine includes a wrench assembly used to make up and break out threaded connections. This wrench assembly is mounted for axial movement on rails of the top head drive assembly, and is positioned immediately under the quill. The top head drive assembly also includes a tubular support assembly which includes slip type inserts for supporting a string of down hole tubulars. This support assembly can be pivoted out of alignment with the drilling axis or can be locked in alignment with the drilling axis. A plurality of centering elements are mounted under the support assembly and are movable to center the upper end of a tubular for insertion into the tubular support assembly. Preferably, both the top head drive assembly load beam and the support beam of the support assembly are formed of box sections having converging side plates and internal diagonal brace plates which transmit downward forces on the beam into forces tending to cause the side plates to diverge. Divergence of the side plates is prevented by support plates which surround the beam.

27 Claims, 8 Drawing Sheets

FIG. 6
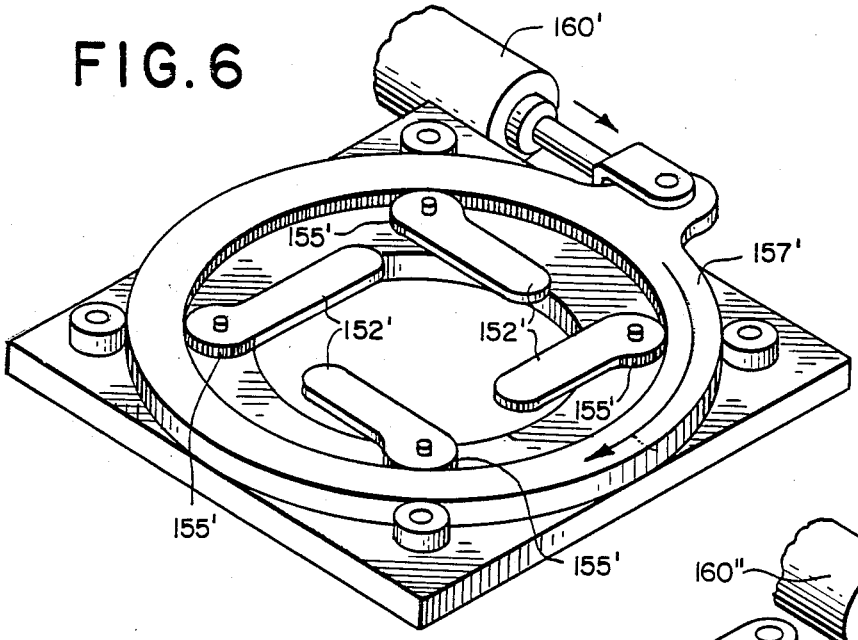
FIG. 7
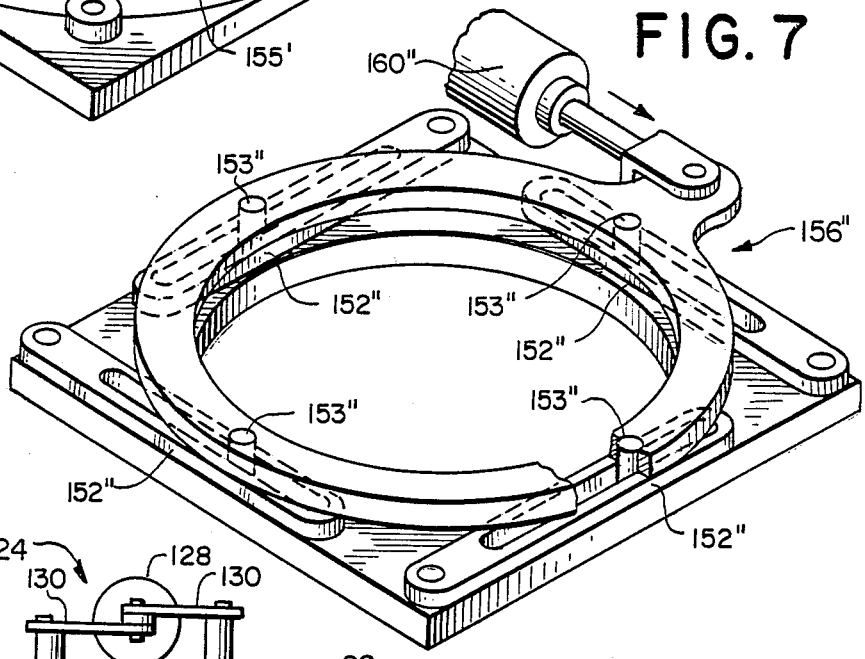
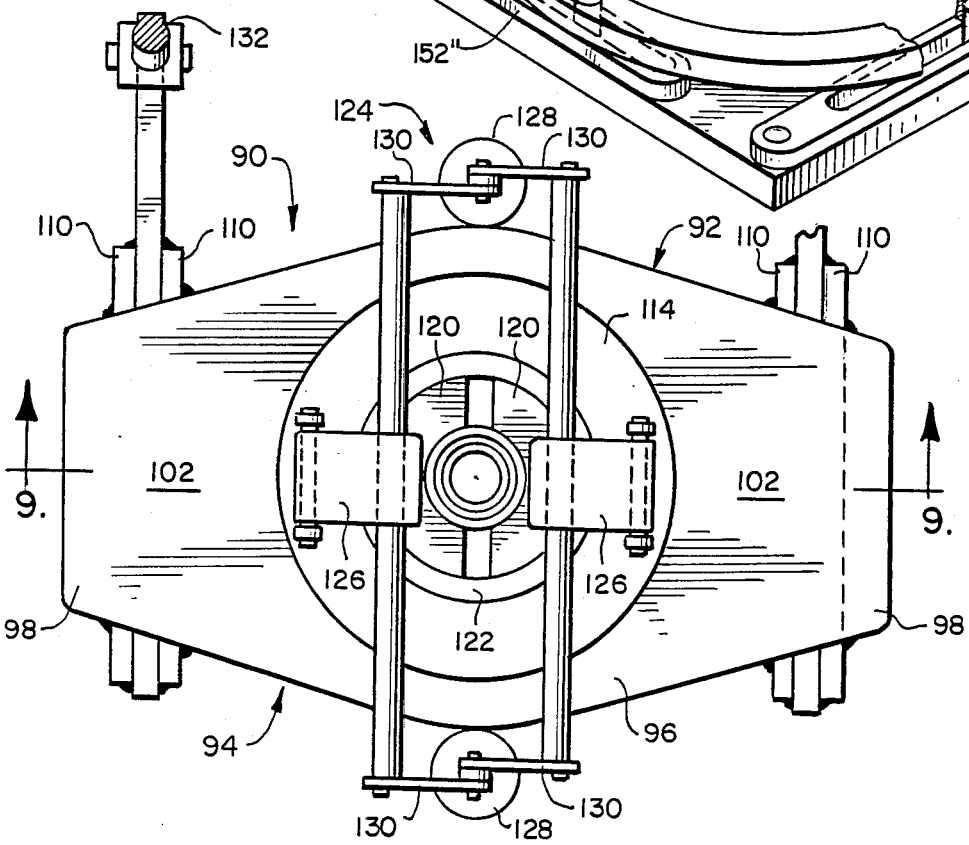
FIG. 8

FIG. 9
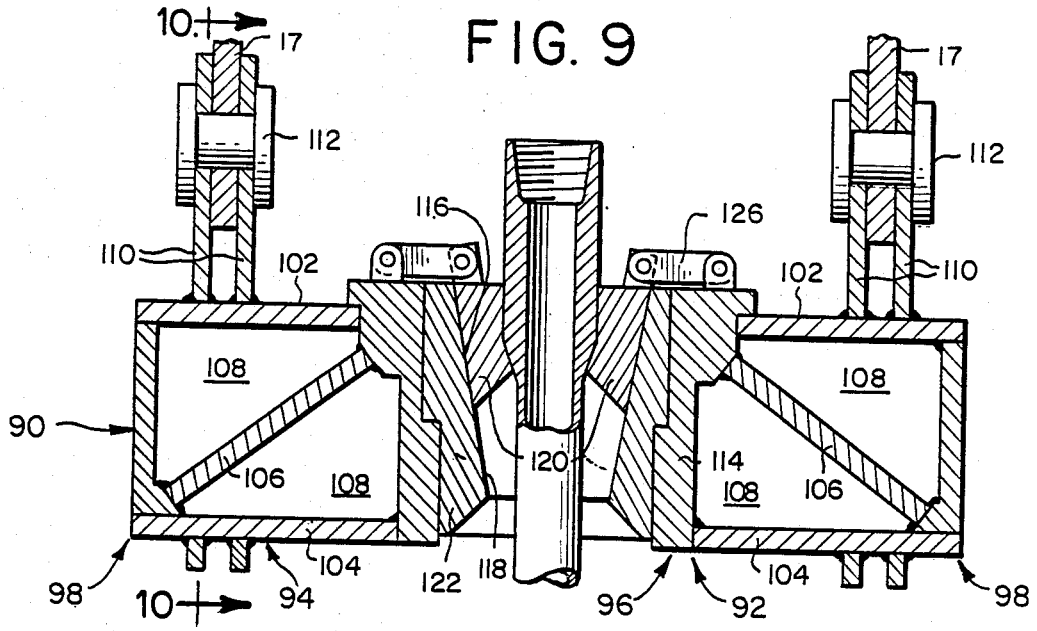
FIG. 10
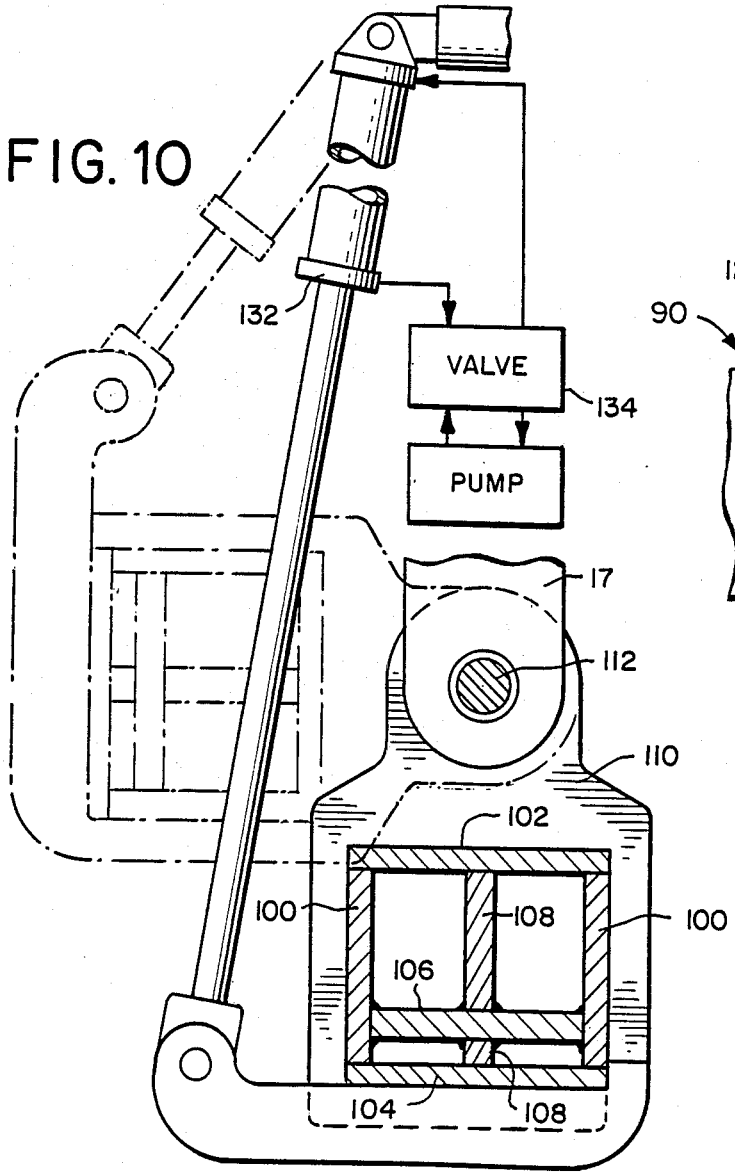
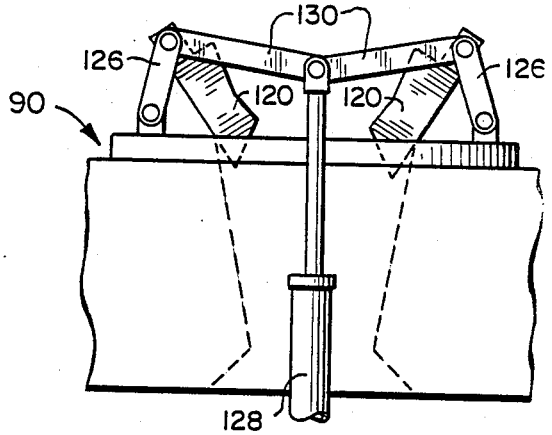
FIG. 9a

FIG. 11
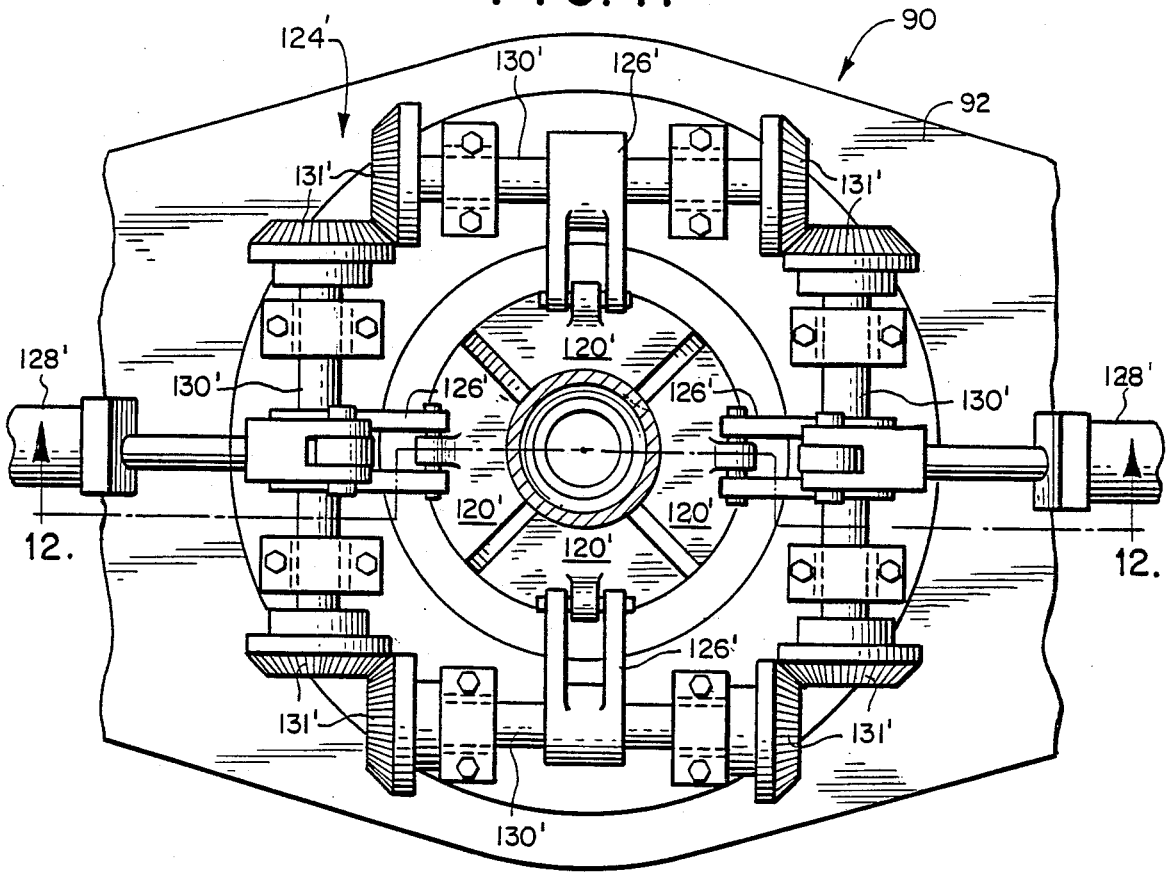
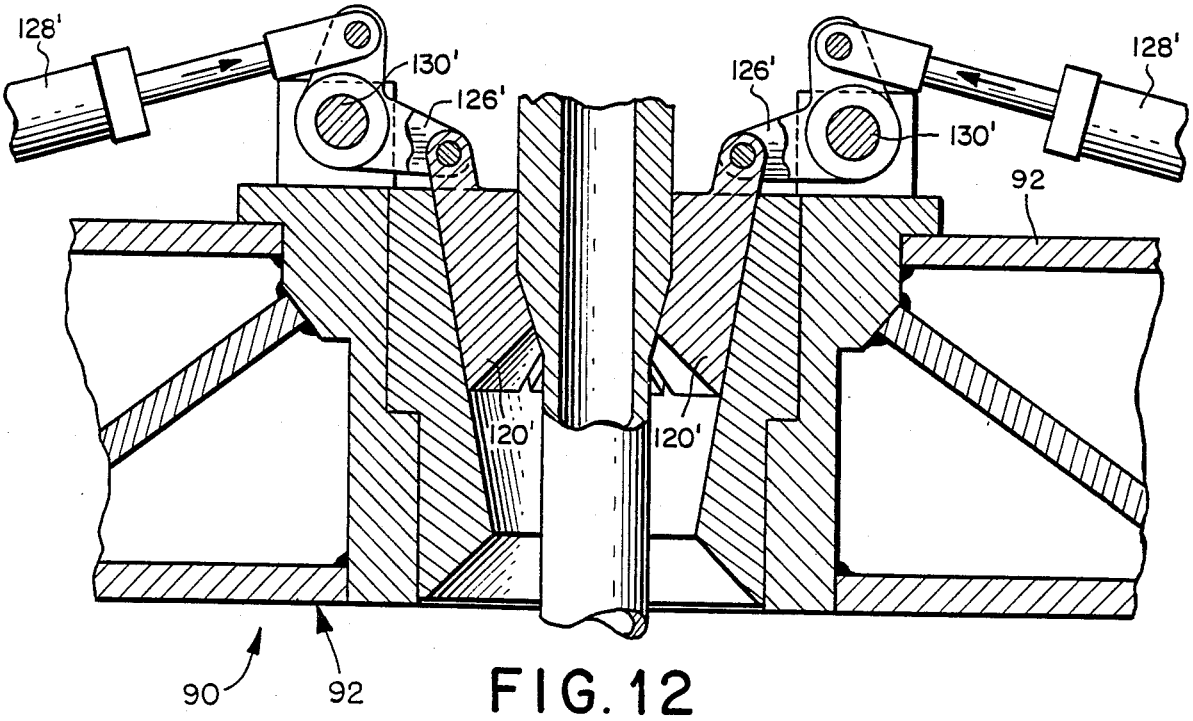
FIG. 12

FIG. 14
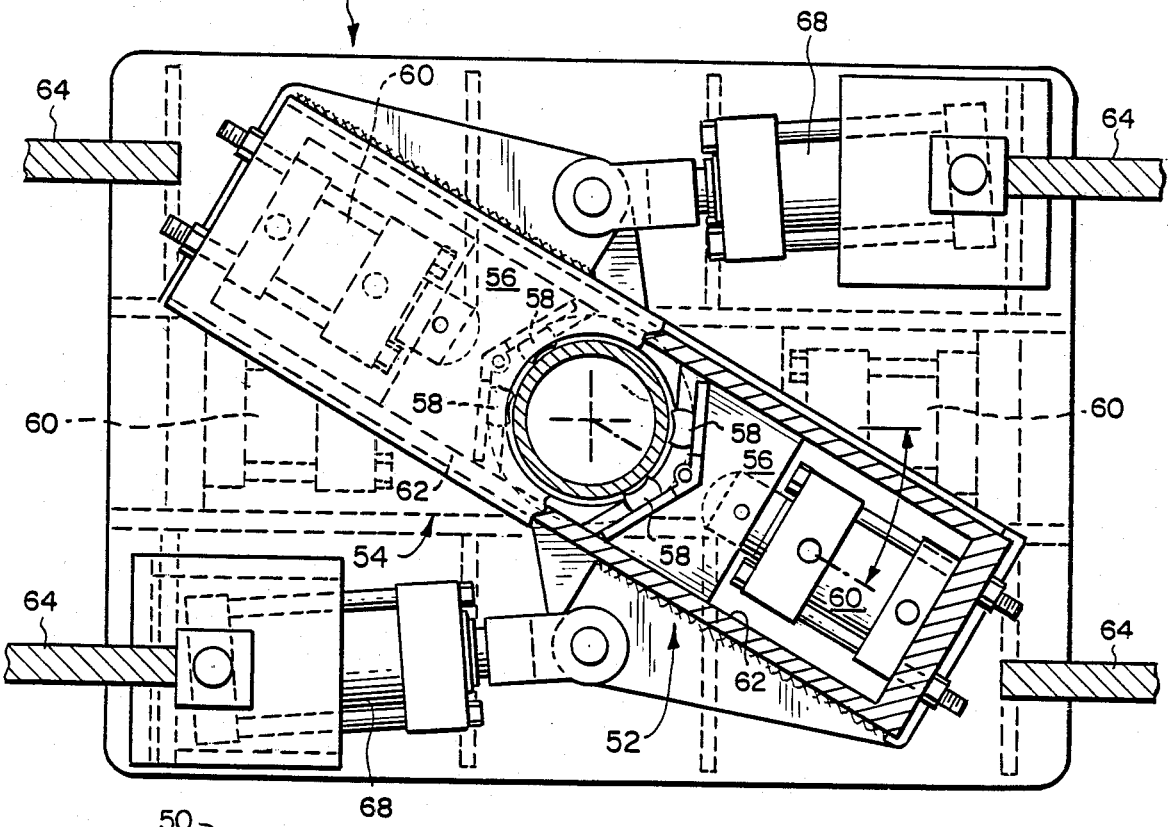
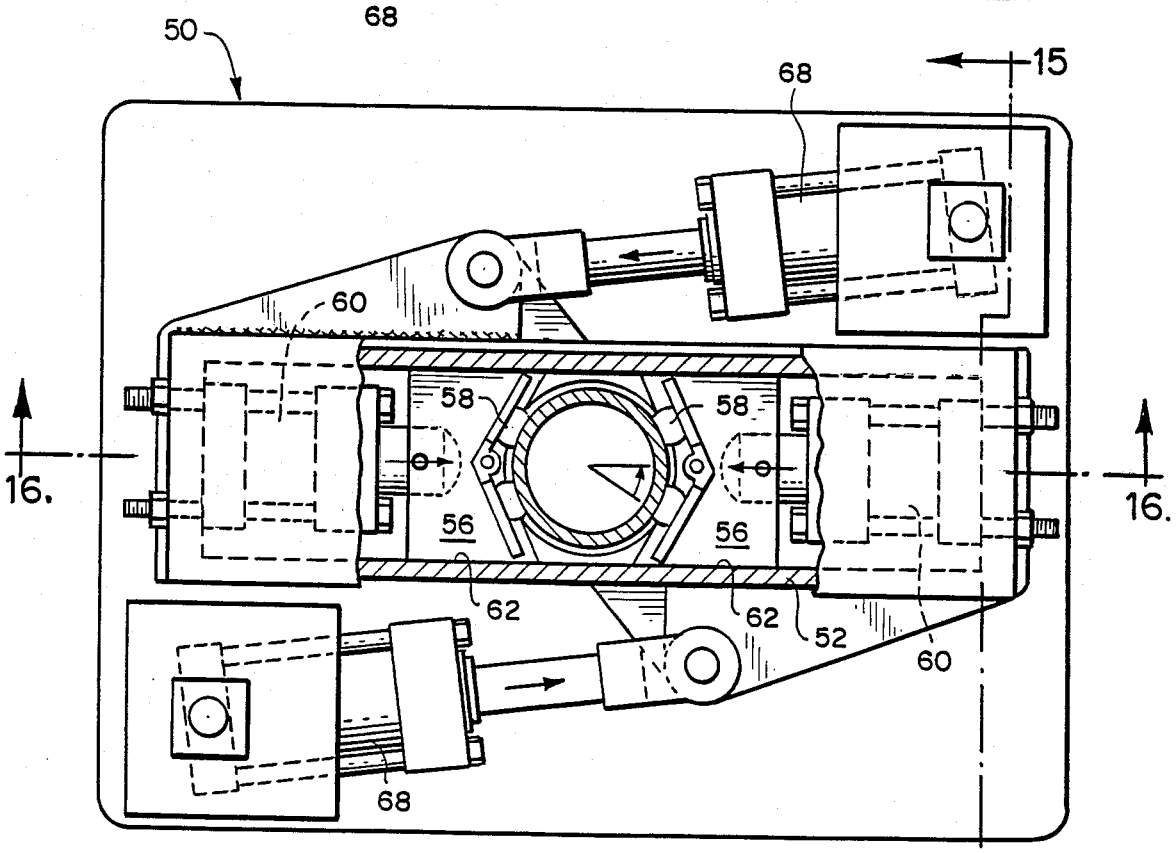
FIG. 13

50
52
54
56
58
60
62
64
66
68
32
34

TOP HEAD DRIVE ASSEMBLY FOR EARTH DRILLING MACHINE AND COMPONENTS THEREOF

BACKGROUND OF THE INVENTION

This invention relates to improvements to a top head drive assembly for an earth drilling machine such as a machine for drilling oil or water wells.

High speed, automatic operation is becoming increasingly important for a wide range of earth drilling machines. High speed operation reduces the drilling time and automatic operation reduces the number of drillers required at the drilling site. Both of these factors substantially reduce drilling costs, and automatic operation provides the added advantage of reduced injury to drillers.

Another important factor in drilling machines is that significant advantages can be obtained by minimizing the overall height of the drilling machine and in particular the drilling mast. By reducing the height of the drilling machine, the weight of the drilling machine and its susceptibility to wind loading problems are both reduced. These factors can result in important savings in the size and cost of the drilling machine, along with important advantages in terms of increased mobility, lower moving costs and faster rig-up and rig-down times.

It is an object of the present invention to provide an improved top head drive assembly and components for a top head drive assembly which minimize the height of the top head drive assembly and which cooperate to facilitate high speed, remote controlled automatic drilling operations.

SUMMARY OF THE INVENTION

According to a first aspect of this invention, a top head drive assembly for an earth drilling machine of the type comprising a load beam, means for guiding the load beam for movement along a mast, a quill supported on the load beam, and means for rotating the quill, is provided with a pair of spaced support rails suspended from the load beam. A wrench assembly comprising an upper clamp adapted to clamp an upper tubular, a lower clamp adapted to clamp a lower tubular and means coupled between the upper and lower clamps for rotating one with respect to the other to torque one of the upper and lower tubulars with respect to the other is guided along support rails under the load beam. Means are provided for moving the wrench assembly along the rails and a tubular support assembly is provided beneath the wrench assembly. This tubular support assembly comprises a support beam, means mounted on the support beam for releasably supporting a tubular which may support a string of tubulars in the well bore, means for controlling the support means to selectively release and engage the tubular, means for pivotably mounting the tubular support assembly from the rails, and means for pivoting the tubular support assembly between an operative position aligned with an axis defined by the quill under the wrench assembly and a storage position laterally offset from the wrench assembly.

This aspect of the invention provides important advantages in that both the wrench assembly and the tubular support assembly are supported by the load beam to move with the load beam to provide a compact unit. Preferably, the tubular support assembly can be locked in the operative position such that the tubular support assembly will center a supported tubular properly for insertion into the wrench assembly.

According to a second aspect of this invention, a tubular support assembly, which may for example be used in the invention described above, comprises a support beam having first and second ends and an opening passing through the beam intermediate of the ends. A bowl is positioned in the opening and secured to the support beam. This bowl defines an inner surface which forms a larger diameter in an upper region and a smaller diameter in a lower region. At least a pair of inserts are shaped to fit within the bowl to support a down hole tubular. Means are provided for moving the inserts between an upper position in which the inserts are positioned to allow the down hole tubular to be inserted in and removed from the bowl opening, and a lower position, in which the inserts are positioned in the retainer opening to support the down hole tubular. The ends of the support beam are rigidly supported on the top head drive assembly such that the opening is held in alignment with a drilling axis defined by the top head drive assembly.

According to a third aspect of this invention, an apparatus for supporting a down hole tubular beneath a top head drive assembly, which may be of the type described above, is provided with means for centering a down hole tubular. Preferably, the centering means includes a plurality of centering elements, means for pivotably mounting the centering elements under the apparatus such that the centering elements are movable to approach and move away from a drilling axis, and means for moving the centering elements toward the drilling axis to center a down hole tubular under the apparatus. This aspect of the invention positively centers tubulars such as crooked or bent drill pipe for insertion into the tubular support apparatus.

According to a fourth aspect of this invention, a support or load beam is provided which may be used in either the top head drive assembly or the tubular support apparatus. This beam comprises a support member adapted to support a load bearing member such as the quill of the top head drive assembly or the upper joint of a drill string. A box section is disposed around the support member, and this box section tapers in width from the support member toward each end. First and second diagonal braces are disposed in the box section, each tapering in width from a wider upper end which abuts the support member to a narrower lower end situated adjacent to a lower portion of a respective one of the ends of the box section. A plurality of support elements are provided, each positioned to surround the box section adjacent to a respective end to resist any increase in width of the box section. The braces are positioned such that downward forces on the support member tend to increase the width of the box section adjacent the support elements. In this way an extremely rigid beam is provided which does not rely entirely on welds for strength.

It will become apparent in the following description of the presently preferred embodiment that the various aspects of this invention cooperate to provide a top head drive assembly which is extremely compact in overall height and which is well-suited to automatic high speed operation. The centering means centers a crooked tubular for quick makeup; the tubular support assembly supports the tubular quickly, without requiring that any threaded coupling be made, and it rigidly supports the tubular or drill string or casing string on the drilling axis. The movable wrench assembly can readily and remotely be moved into the desired axial position so as to align itself with a threaded joint to supply the desired make up or break out torque. The entire assembly can readily be adapted for use with either casing or drill pipe. In a particularly preferred form of the invention, the top head drive assembly can be equipped with an apparatus for engaging the quill of the top head drive assembly with an interior portion of a tubular in order to allow the quill to rotate the tubular as desired. A suitable device for providing this function is described in co-pending application Ser. No. 07/034,482.

The invention itself, together with further objects and attendant advantages, will best be understood by reference to the following detailed description, taken in conjunction with the accompanying drawings.

BRIEF DESCRIPTION OF THE DRAWINGS

FIG. 6 is perspective view of an alternate embodiment of the centering device of this invention.

FIG. 7 is a perspective view of another alternate embodiment of the centering device of this invention.

FIG. 8 is a sectional view taken along line 8—8 of FIG. 1.

FIG. 9 is a sectional view taken along line 9—9 of FIG. 8.

FIG. **9*a* is a view similar to FIG. 9** showing the inserts in a raised position.

FIG. 10 is a sectional view taken along line 10—10 of FIG. 9.

FIG. 11 is a top view of an alternate embodiment of the tubular support assembly of this invention.

FIG. 12 is a sectional view taken along line 12—12 of FIG. 11.

Figure 1:
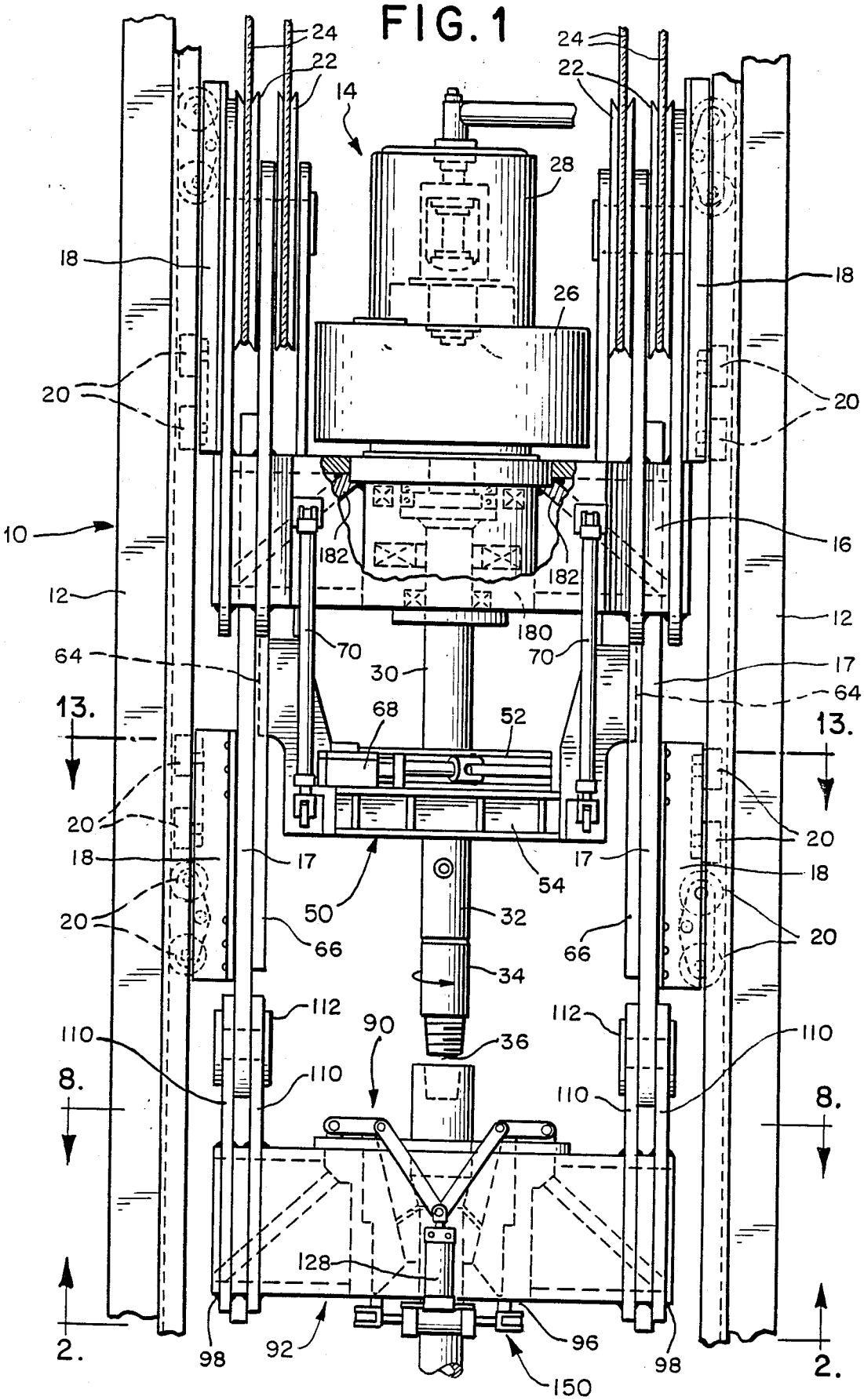
FIG. 1 is a front elevational view of a portion of a drilling machine which incorporates a top head drive assembly that incorporates presently preferred embodiments of this invention.

FIG. 13 is a sectional view taken along line 13—13 of FIG. 1 showing a preferred embodiment of the wrench assembly of this invention.

FIG. 14 is a view similar to FIG. 13 showing the wrench assembly with the upper wrench in a rotated position.

Figures 15, 16:
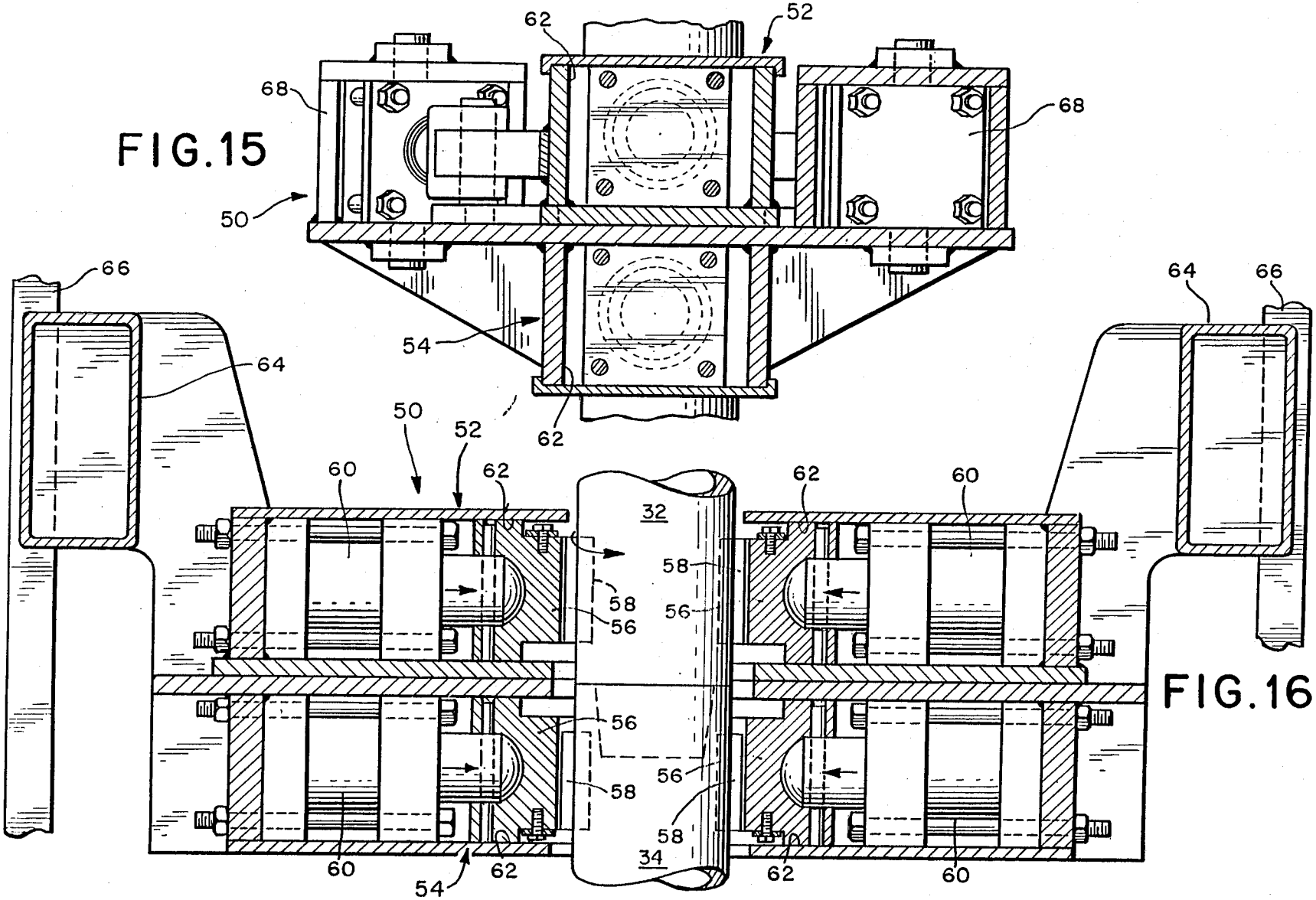

FIG. 15 is a sectional view taken along line 15—15 of FIG. 13.

FIG. 16 is a sectional view taken along line 16—16 of FIG. 13.

Figure 17:
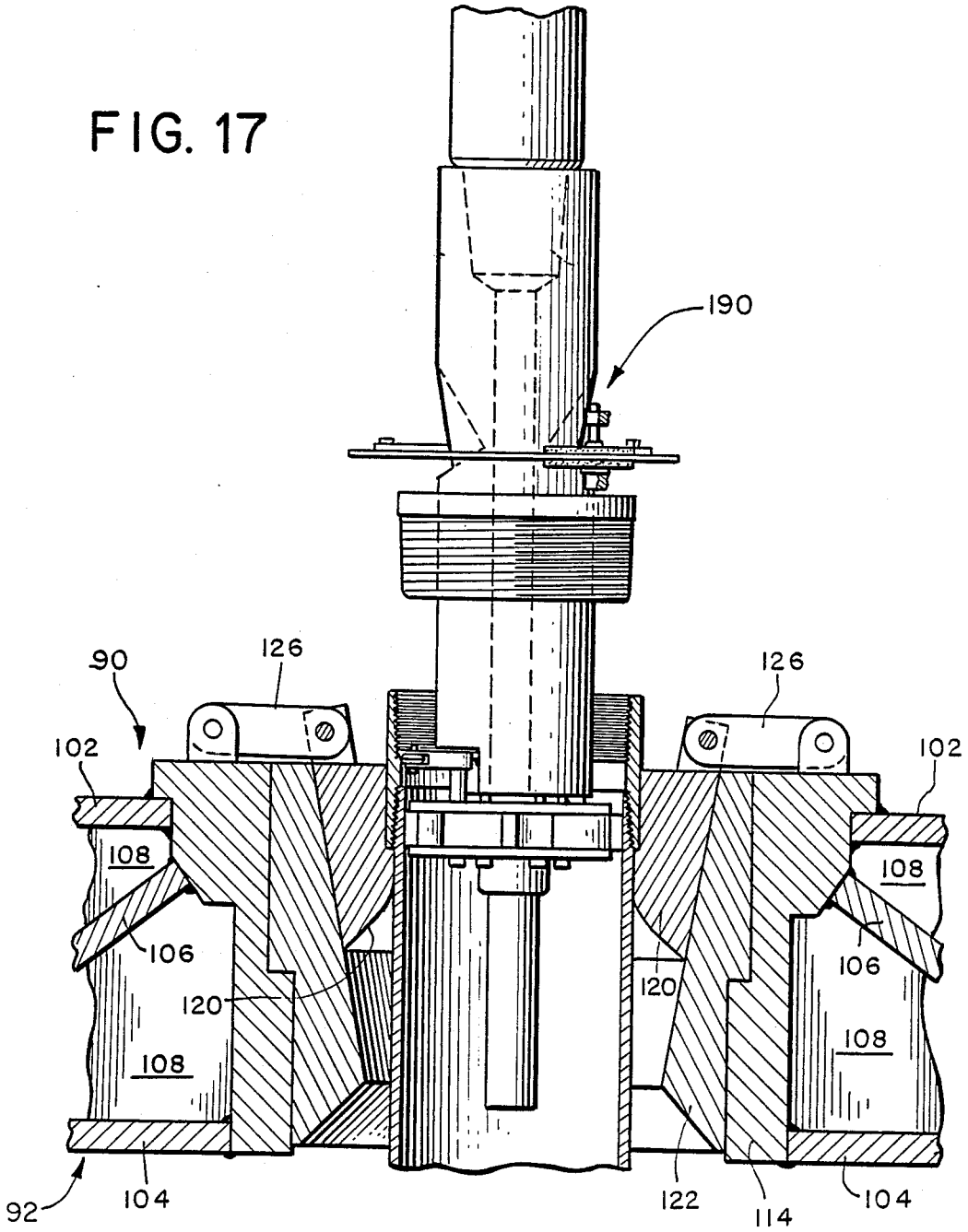

FIG. 17 is a sectional view in the plane of FIG. 9 showing the embodiment of FIG. 9 in use.

DETAILED DESCRIPTION OF THE PRESENTLY PREFERRED EMBODIMENTS

Turning now to the drawings, FIG. 1 shows an elevational view of a drilling machine 10 that includes a mast 12 and a top head drive assembly 14. The top head drive assembly 14 includes a load beam 16 which is secured at each end to a pair of top head drive tracking assembly 18. The top head drive tracking assemblies 18 are provided with rollers 20 which guide the top head drive assembly 14 for movement along channels on the mast legs 12. Two sets of sheaves 22 are secured to the load beam 16, and these sheaves 22 suspend the top head drive assembly 14 from a cable 24. This cable 24 operates to move the top head drive assembly 14 along the length of the mast 12.

The load beam 16 also supports a transmission 26 and a pair of electric motors 28. The motors 28 and the transmission 26 cooperate to make up a means for rotating a quill 30 which is rotatably supported in the load beam 16. The quill 30 defines a lower threaded end which can be threadedly engaged with a string of tubulars which may for example include an upper tubular 32 and lower tubular 34. As used herein the term "tubular" is used to signify a tubular element used in a down hole drilling or well service operation, and is meant to include the full range of drill pipe, drill casing, adapter subs, blowout preventer subs and the like. In general, an entire string of tubulars will extend along a drilling axis 36, and the quill 30 is used to support and rotate the tubulars about the drilling axis 36.

The features of the drilling machine 10 described above are well-known to those skilled in the art and do not therefore form any part of this invention. These details have been provided merely to clarify the environment of the present invention. U.S. Pat. No. 4,314,611, assigned to the assignee of the present invention, discloses one prior art top head drive assembly incorporating these features. The presently preferred form of the top head drive assembly 14 is defined in greater detail in co-pending U.S. Patent Applications Ser. Nos. 07/034,483 and 07/034,481.

According to this invention, the top head drive assembly 14 is provided with a wrench assembly 50. This wrench assembly 50 as shown in FIGS. 13–16 includes an upper clamp 52 and a lower clamp 54. Each of the clamps 52, 54 includes an opposed pair of jaws 56, each of which is provided with a pair of rotatable tubular gripping inserts 58. The jaws 56 are positioned by clamping cylinders 60 which move the jaws 56 along respective jaw guides 62.

The details of construction of the clamps 52, 54 are largely conventional. For example, the structure of the inserts 58 is described in detail in U.S. Pat. No. 4,475,607, assigned to the assignee of the present invention. The jaw guides 62 can be formed as described in U.S. Pat. No. 4,303,270, also assigned to the assignee of this invention.

The lower clamp 54 defines a pair of opposed wrench guides 64 which are positioned to slide in wrench guide tracks 66 mounted on the load bars or support rails 17 which support the tubular support beam 92. These wrench guide tracks 66 are diametrically opposed with respect to the drilling axis 36, and they guide the wrench assembly 50 in axial movement parallel to the drilling axis 36 while resisting any tendency of the wrench assembly 50 to rotate with respect to the top head drive assembly 14. A pair of rotating cylinders 68 are mounted between the upper and lower clamps 52, 54. These rotating cylinders 68 operate to rotate the upper clamp 52 by about 30° with respect to the lower clamp 54 between the two extreme positions shown in FIGS. 13 and 14. Thus, the rotating cylinders 68 supply a defined torque to the upper clamp 52 and can be used to make up or break out a threaded connection.

The entire wrench assembly 50 can be moved axially along the wrench guide tracks 66 by means of positioning cylinders 70 (FIG. 1). These positioning cylinders 70 are mounted between the wrench assembly 50 and the load beam 16, and can be extended and retracted in order to position the wrench assembly 50 appropriately such that the upper clamp 52 is positioned to engage the upper tubular 32 and the lower clamp 54 is positioned to engage the lower tubular 34.

In use, the positioning cylinders 70 are used to position the wrench assembly 50 appropriately with respect to the threaded joint which is to be made up or broken out (FIG. 16). Then the upper and lower clamps 52, 54 are closed on the tubulars 32, 34 by supplying pressurized hydraulic fluid to the clamping cylinders 60. At this point the upper and lower clamps 52, 54 are positively engaged with respect to the tubulars 32, 34, respectively (FIG. 16). Then the rotating cylinders 68 are activated in order to rotate the upper clamp 52 with respect to the lower clamp 54 in order to supply the desired make up or break out torque.

The function performed by the wrench assembly 50 is similar in some respects to that performed by the self-centering tongs described in U.S. Pat. No. 4,403,666, assigned to the assignee of the present invention. However, the upper and lower clamps 52, 54 do not require any self-centering mechanism as described in that patent.

Turning now to FIGS. 8–10, in accordance with this invention the top head drive assembly 14 also includes a tubular support assembly 90. This tubular support assembly 90 includes a support beam 92 which is formed of a box section 94. This box section 94 tapers from a central section 96 which defines an opening as described below, and a pair of end sections 98 (FIG. 8). The box section 94 is formed of two opposed side plates 100 which approach one another at the ends, a top plate 102 and a bottom plate 104, all of which are securely welded together.

The box section 94 also includes a pair of diagonal brace plates 106. These brace plates 106 slant downwardly from an upper inner end near the central section 96 to a lower outer end near the respective end section 98. The diagonal brace plates 106 are welded in place to the side plates 100 along substantially the entire distance between the central section 96 and the end sections 98. Preferably, gussets 108 are provided to prevent the diagonal brace plates 106 from buckling. The support beam 92 is supported in place by support plates 110 which are pivotably mounted to the guide rails 18 by means of pivots 112. It is important to note as shown in FIG. 10 that the support plates 110 completely surround the box section 94 at the end sections 98.

As best shown in FIGS. 9 and **9*a*, the support assembly 90 includes an insert retainer bowl 114 which is positioned in the opening in the central section 96 and is engaged with the diagonal brace plates 106. Preferably, the insert retainer bowl 114 is shaped so as to capture the diagonal brace plates 106** mechanically, in addition to whatever welds or other fastening means are provided.

One or more adapter bowls 122 can be positioned within the insert retainer bowl 114 in order to change the effective diameter of the retainer bowl 114 in order to adapt it for use with tubulars of varying diameters. The adapter bowl 122 defines a larger diameter upper portion 116 and a smaller diameter lower portion 118. The adapter bowl 122 serves to support a plurality of inserts 120. These inserts act as slip inserts to mechanically engage and support the tubular. The inserts may be adapted to support drill pipe as shown in FIG. 9 or casing as shown in FIG. 17.

As best shown in FIGS. 9 and **9*a* means 124 also (FIGS. 8 & 11) are provided for moving the inserts 120 between a lower position in which the inserts 120 surround, capture, and support the tubular (FIG. 9), and an upper position in which the inserts are positioned substantially out of the retainer bowl 114 (FIG. 9*a*) to allow tubulars to be inserted into and removed from the retainer bowl 114. Each of the inserts 120 is pivotably mounted to a respective link 126. Each of the links 126 is in turn pivotably connected to the support beam 92. The position of the links 126 and therefore the position of the inserts 120 is controlled by a pair of hydraulic cylinders 128. These hydraulic cylinders 128 are mounted to the sides of the support beam 92 and are coupled to the links 126 by means of coupling elements 130. The coupling elements 130 in this embodiment are Y shaped and operate to synchronize the movement of the inserts 120. By selectively extending and retracting the hydraulic cylinders 128, the inserts 120** can be moved between the lower position and the upper position.

The position of the support assembly 90 under the quill 30 is controlled by a pair of pivot cylinders 132 which are connected between the support beam 92 and the load beam 16 (FIG. 10). When retracted these pivot cylinders 132 pivot the support assembly 90 away from the drilling axis 36 to a storage position. When it is desired to make use of the support assembly 90 the pivot cylinders 132 are extended to align the support assembly 90 with the drilling axis 36. Means 134 are provided for hydraulically locking the pivot cylinders 132 in this position, in order positively to lock the support assembly 90 in position with the insert retainer bowl 114 centered on the drilling axis 36. By locking the support assembly 90 in position, the support assembly 90 can be used to ensure that a tubular supported by the support assembly 90 is properly aligned with the drilling axis 36. This simplifies tubular handling operations.

Of course, a wide ranges of alternative arrangements can be used for synchronizing the movement of the inserts 120. For example, FIGS. 11 and 12 show an alternative arrangement in which four inserts 120' are used. These inserts 120' are positioned by means 124' which include four separate links 126'. Each of the links 126' is pivotably connected at one end to the respective insert 120' and at the other end to the support beam 92'. The four links 126' are interconnected by coupling shafts 130' which are interconnected by means of bevel gears 131'. A plurality of hydraulic cylinders 128' are provided to rotate the links 126' and therefore the inserts 120'. The coupling elements 130' and the bevel gears 131' ensure that all of the inserts 120' move in synchronization.

Figure 5:
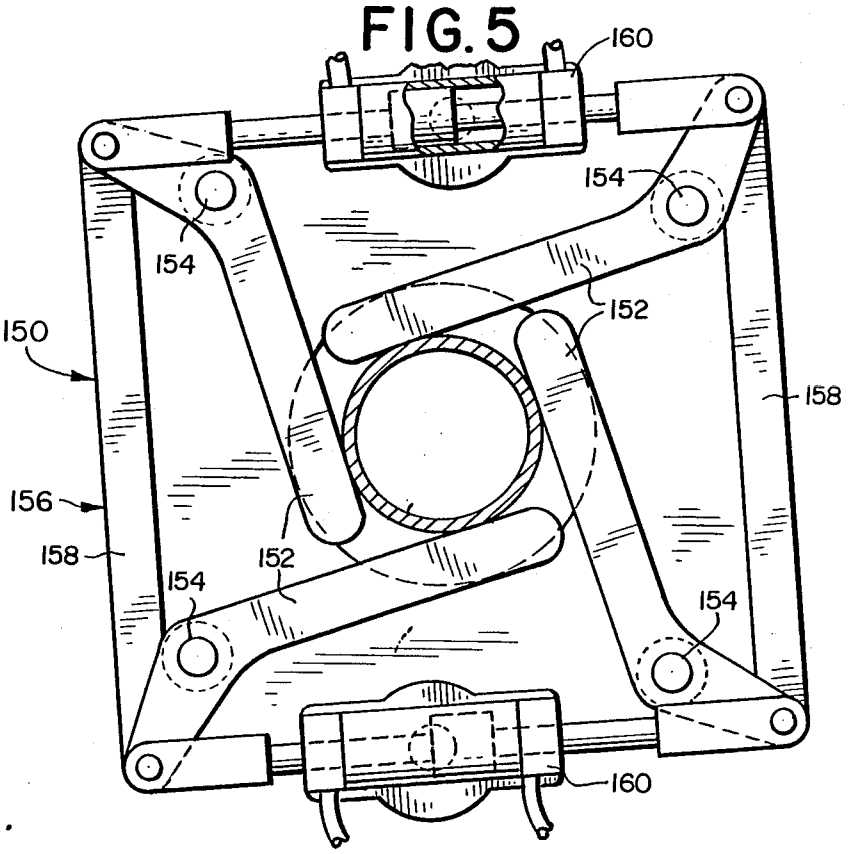
FIG. 5 is a bottom view corresponding to FIG. 2 showing the centering device with the centering elements in inner positions.
Figure 4:
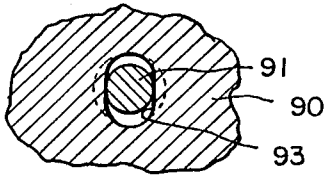
FIG. 4 is a sectional view taken along line 4—4 of FIG. 3.
Figure 2:
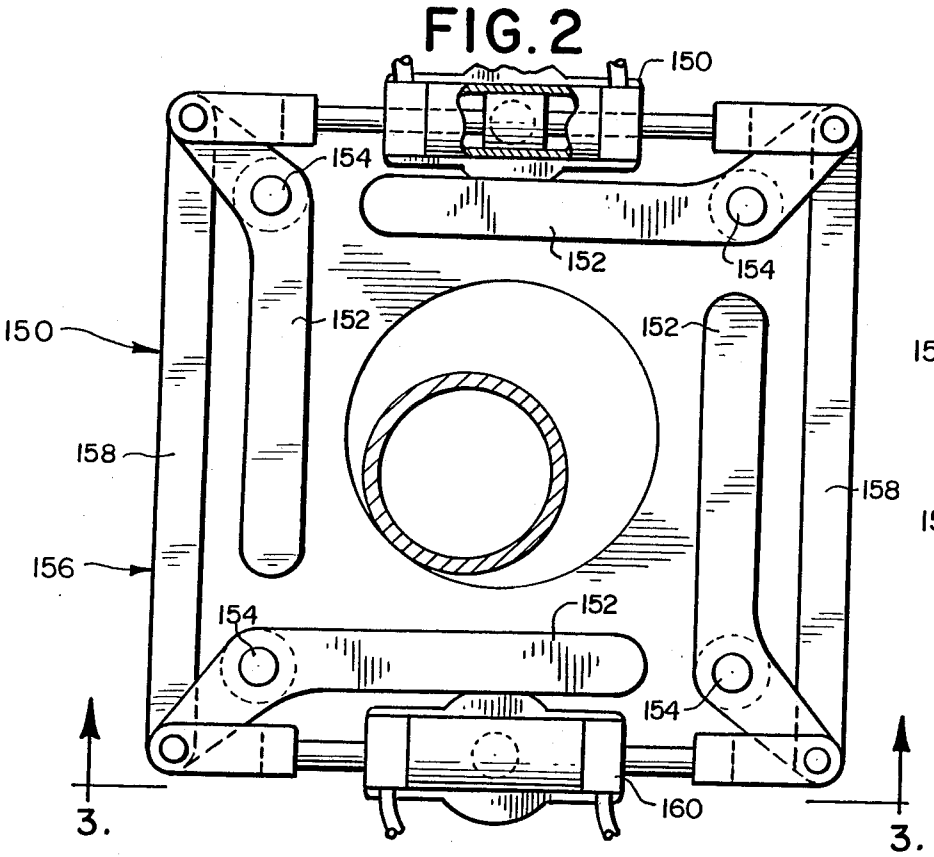
FIG. 2 is a bottom view of a centering device taken along line 2—2 of FIG. 1.
Figure 3:
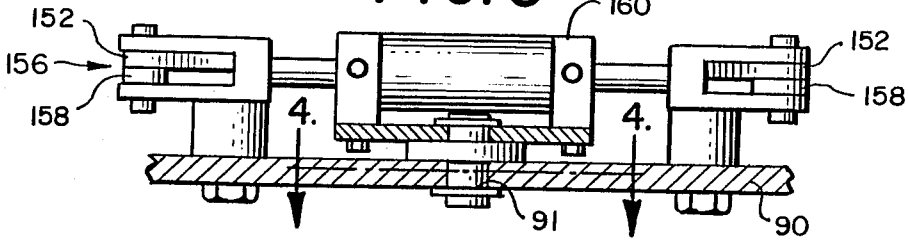
FIG. 3 is a side view taken along line 3—3 of FIG. 2.

As best shown in FIGS. 2–5, a centering means 150 is mounted to the lower side of the support assembly 90. This centering means 150 includes a plurality of centering elements 152, each of which is mounted to pivot about a respective pivot axis 154. Means are provided for sweeping the centering elements 152 in unison between an outer position as shown in FIG. 2 and an inner position as shown in FIG. 5. This sweeping means 156 includes a set of synchronizing links 158 which ensure that the centering elements 152 move in unison and at least one actuating cylinder 160. Each of the cylinders 160 is mounted to the support assembly 90 via a pin 91 which is received in a slot 93 that allows rotational movement and limited radial movement to the cylinder 90 (FIG. 4). When it is desired to center a crooked tubular, the cylinders 160 are used to move the centering elements 152 to the outer position. Then the top head drive assembly 14 is lowered until the tubular crosses the plane of the centering elements 152 (FIG. 2). At this point, the tubular is supported by other means, such as for example by conventional slips located at the drilling floor (not shown). Then the cylinders 160 are actuated to move the centering elements 152 inwardly, thereby forcing the upper end of the tubular into alignment with the drilling axis 36 (FIG. 5).

Of course, the centering means 150 can be embodied in other forms. In the embodiment of FIG. 6 each of the centering elements 152′ is provided with a geared end 155′ which engages as an internal toothed surface of a ring gear 157′. This gear 157′ is rotated by a hydraulic cylinder 160′ in order to sweep the centering elements 152′ between inner and outer positions. FIG. 7 shows another alternative in which the centering elements 152″ are provided with pins 153″. In this embodiment the means for sweeping 156″ includes a ring 157″ having slots which engage the pins 153″. An actuating cylinder 160″ rotates the ring 157″ so as to sweep the centering elements 152″ between inner and outer positions.

The load beam 16 of the top head drive assembly 14 can advantageously be provided with a structure quite similar to that of the support beam 92. As shown in FIG. 1, the load beam 16 includes a quill support bowl 180 which serves a function similar to that of the insert retainer bowl 114 described above. Preferably, the load beam 16 is provided with a box section similar to that of the box section 94 described above, and a pair of diagonal braces 182 are provided which are mechanically interlocked with the quill support bowl 180 in a manner similar to that described above in conjunction with the diagonal brace plates 106.

Preferably, the top head drive assembly 14 is provided with means for non-threadedly engaging the quill 30 with the upper end of a tubular supported in the support assembly 90 (FIG. 17). The presently preferred embodiment of this means is described in co-pending U.S. Patent Application Ser. No. 07/034,482. This device is threadedly engaged to the quill 30 and includes a set of internal jaws positioned to engage an interior surface of the tubular. When the jaws are set the quill is rotatably engaged with the tubular, and the motors 28 of the top head drive assembly 14 can be used to rotate the tubular and to supply a selected torque, as for example in order to make up a threaded connection near the drilling rig floor.

OPERATION

In operation the components of the top head drive assembly 14 described above provide a remarkably compact, high speed, efficient top head drive assembly. Preferably, this top head drive assembly 14 is used with a pipe boom such as that described in U.S. Pat. No. 4,407,629, assigned to the assignee of this invention. This pipe boom moves between a lower position aligned with ground level and an upper position aligned with the drilling axis, and the pipe boom is used to move a length of tubular between ground level and alignment with the drilling axis 36. Once the pipe boom has moved a tubular into alignment with the drilling axis 36, the support assembly 90 can be used to support the tubular quickly, without requiring that any threaded connection be made with the tubular. Once the tubular is supported in the support assembly 90, the pipe boom can be moved back to the lower position. The centering means 150 can be used to ensure that the tubular is centered properly in alignment with the drilling axis 36 such that the support assembly 90 can be lowered over the upper end of the tubular. The support assembly 90 operates in an effective manner because the retainer bowl 114 provides a closed loop around the tubular. By operating in the manner of conventional slips, the support assembly 90 can support extremely high downward forces. The box section 94 provides a rigid beam which does not depend entirely on welds or other fasteners for strength. As increasing downward forces are applied to the retainer bowl 114 or the support bowl 180, these downward forces tend to move the brace plates 106, 182 downwardly, thereby tending to spread the converging side plates 100. However, the side plates 100 are prevented from spreading by the support plates 110 which surround the box section 94 near the end sections 98. Because the side plates 100 are confined in position the brace plates 106 are prevented from moving downwardly and the beam 92 is prevented from sagging. In this way, an unusually shallow beam can be used to support a string of tubulars safely. Finally, the wrench assembly 50 can be positioned as desired under the quill 30 to ensure that the threaded connections between adjacent tubulars (such as between a blowout preventer sub and an adapter sub) can be quickly and automatically made up to a desired torque or broken out. In this way, high torque threaded connections are provided which provide excellent resistance to leakage of drilling fluid and associated hazards.

Though it is preferred to use each of the components described above in cooperation it is not essential to do so in all cases. The wrench assembly 50, the support assembly 90 and the centering means 150 can all be used in various combinations to perform their respective functions.

Of course, it should be understood that a wide range of changes and modifications can be made to the preferred embodiments described above. It is therefore intended that the foregoing detailed description be regarded as illustrative rather than limiting, and that it be understood that it is the following claims, including all equivalents, which are intended to define the scope of this invention.

I claim:

1. An apparatus for supporting a down hole tubular beneath a top head drive assembly of an earth drilling machine, said apparatus comprising:

a support beam having first and second ends and an opening passing through the beam intermediate the ends;

an insert retainer positioned in the opening and secured to the support beam, said insert retainer defining an inner surface which forms a larger diameter in an upper region and a smaller diameter in a lower region;

at least a pair of inserts shaped to fit within the retainer and to engage an upper shoulder on a down hole tubular and thereby support the down hole tubular;

remotely actuated means for moving the inserts between an upper position, in which the inserts are positioned to allow the down hole tubular to be inserted in and removed from the retainer opening, and a lower position, in which the inserts are positioned in the retainer opening to support the down hole tubular; and means for rigidly supporting the ends of the support beam on the top head drive assembly such that the opening is held in alignment with a drilling axis defined by the top head drive assembly;

said supporting means comprising means for pivotably supporting the support beam from the top head drive assembly, means for pivoting the support beam between an upper, storage position offset to one side from the drilling axis and a lower, operative position in alignment with the drilling axis.

2. The invention of claim 1 wherein the support beam comprises:

a box section which tapers in width from the opening toward each end;

first and second diagonal braces disposed in the box section;

said braces each tapering in width from a wider, upper end which abuts the insert retainer to a narrower, lower end situated adjacent a lower portion of a respective one of the ends of the box section; and at least a pair of support elements, each positioned to surround the box section adjacent a respective end to resist any increase in width of the box section;

said braces positioned such that downward forces on the insert retainer tend to increase the width of the box section adjacent the support elements.

3. The invention of claim 2 wherein each of said support elements is pivotably mounted to the top head drive assembly.

4. The invention of claim 1 wherein the means for moving the inserts comprises:

means for hingedly mounting an upper portion of each of the inserts in place with respect to the support beam;

at least one hydraulic cylinder mounted to the support beam; and means for coupling the cylinder to the inserts such that the cylinder is operative to move the inserts between the upper and lower positions.

5. The invention of claim 4 wherein the mounting means comprises a plurality of links, each hingedly mounted at one end to a respective one of the inserts and at the other end about an axis which is fixed with respect to the support beam.

6. The invention of claim 1 further comprising means for rigidly locking the pivoting means to hold the support beam in the operative position.

7. The invention of claim 1 wherein the support beam comprises a box section comprising:

a plurality of spaced, parallel upper and lower plates which increase in width from a narrower width adjacent the ends of the load beam to a wider width adjacent the opening;

a plurality of spaced side plates secured to the upper and lower plates to form the box section;

a pair of brace plates, each positioned in the box section to extend diagonally from the respective end of the load beam adjacent the respective lower plates to the insert retainer adjacent the respective upper plates, each of said brace plates tapering in width away from the insert retainer, and a plurality of support elements, each positioned to surround the box section adjacent a respective end to resist any increase in width of the box section;

said braces positioned such that downward forces on the insert retainer tend to spread the width of the box section adjacent the support elements.

8. The invention of claim 1 further comprising means for centering a down hole tubular under the support beam, said centering means comprising:

a plurality of pairs of opposed centering elements;

means for pivotably mounting the centering elements under the support beam such that the centering elements are movable to approach and move away from the drilling axis; and means for moving the centering elements toward the drilling axis to center a length of down hole tubular under the support beam.

9. The invention of claim 8 wherein the mounting means mounts the centering elements to pivot in respective planes transverse to the drilling axis.

10. The invention of claim 9 wherein the moving means comprises:

means for interconnecting the centering elements to synchronize movement of the centering elements; and means for moving at least one of the centering elements and the interconnecting means.

11. The invention of claim 1 wherein the drilling machine defines a drilling axis, wherein the rigidly supporting means supports the support beam from two support members included in the top head drive assembly at respective support regions, and wherein the support regions are diametrically disposed with respect to the drilling axis.

12. The invention of claim 1 wherein the means for moving the inserts comprises:

a pair of hydraulic cylinders mounted to the support beam, each defining an extension axis parallel to the drilling axis when the opening is held in alignment with the drilling axis;

means for hingedly mounting an upper portion of each of the inserts in place with respect to the support beam;

a pair of bars, each mounted to a respective one of the inserts; and a pair of coupling members, each connecting a respective one of the cylinders with both of the bars;

said cylinders, bars and coupling members configured and positioned to synchronize movement of the inserts between the upper and lower positions.

13. The invention of claim 1 wherein the plurality of inserts comprises four inserts, and wherein the means for moving the inserts comprises:

four links, each hingedly mounted to a respective insert;

four shafts, each rotatably mounted with respect to the support beam, and each secured to a respective one of the links;

a plurality of gears disposed on the shafts to intermesh with one another such that the shafts all rotate in synchronization; and cylinder means for rotating at least one of the shafts to move the inserts between the upper and lower positions.

14. The invention of claim 1 wherein the top head drive assembly comprises a load beam, and wherein the supporting means supports the support beam beneath the load beam by a sufficient distance to accommodate an axially movable wrench assembly therebetween.

15. In a top head drive assembly for an earth drilling machine of the type comprising a load beam, means for guiding the load beam for movement along a mast, a quill supported on the load beam, and means for rotating the quill, the improvement comprising:

a pair of spaced support rails suspended from the load beam;

a wrench assembly comprising:

an upper clamp adapted to clamp an upper tubular;

a lower clamp adapted to clamp a lower tubular; and means, coupled between the upper and lower clamps, for rotating one with respect to the other to torque one of the upper and lower tubulars with respect to the other;

means for guiding the wrench assembly along the rails under the quill;

means for moving the wrench assembly along the rails;

a tubular support assembly comprising:

a support beam;

means, mounted on the support beam, for releasably supporting a tubular; and means for controlling the support means to selectively release and engage the tubular;

means for pivotably mounting the tubular support assembly from the rails; and means for pivoting the tubular support assembly between an operative position aligned with an axis defined by the quill under the wrench assembly and a storage position laterally offset from the wrench assembly.

16. The invention of claim 15 further comprising means for locking the tubular support assembly in the operative position.

17. The invention of claim 16 further comprising means for centering a tubular under the tubular support assembly on the axis.

18. The invention of claim 17 wherein the centering means comprises:

a plurality of pairs of opposed centering elements pivotably mounted under the tubular support assembly; and means for sweeping the centering elements inwardly to center a tubular on the axis.

19. The invention of claim 18 wherein the sweeping means comprises:

means for interconnecting the centering elements to synchronize movement of the centering elements; and means for moving at least one of the centering elements and the interconnecting means to move the centering elements between inner and outer positions.

20. The invention of claim 15 wherein the quill defines a drilling axis and wherein the support rails are positioned on diametrically opposed sides of the drilling axis.

21. The invention of claim 20 wherein the means for releasably supporting a tubular comprises:

a support beam having first and second ends and an opening passing through the support beam intermediate the ends;

an insert retainer positioned in the opening and secured to the support beam, said insert retainer defining an inner surface which forms a larger diameter in an upper region and a smaller diameter in a lower region;

at least a pair of inserts shaped to fit within the retainer and to engage an upper shoulder on a down hole tubular and thereby support the down hole tubular;

remotely actuated means for moving the inserts between an upper position, in which the inserts are positioned to allow the down hole tubular to be inserted in and removed from the retainer opening, and a lower position, in which the inserts are positioned in the retainer opening to support the down hole tubular.

22. An apparatus for supporting a down hole tubular beneath a top head drive assembly of an earth drilling machine, said top head drive assembly defining a drilling axis, said apparatus comprising:

means for engaging and supporting an upper end portion of a length of down hole tubular;

means for supporting the engaging means under the top head drive assembly;

means, included in the supporting means, for positively locking the engaging means in alignment with the drilling axis; and means for centering a down hole tubular under the engaging means, said centering means comprising:

a plurality of pairs of opposed centering elements;

means for pivotably mounting the centering elements under the engaging means such that the centering elements are movable to approach and move away from the drilling axis; and means for moving the centering elements toward the drilling axis to center a length of down hole tubular under the engaging means.

23. The invention of claim 22 wherein the mounting means mounts the centering elements to pivot in respective planes transverse to the drilling axis.

24. The invention of claim 23 wherein the moving means comprises:

a means for interconnecting the centering elements to synchronize movement of the centering elements; and means for moving at least one of the interconnecting means and the centering elements.

25. The invention of claim 24 wherein the mounting means comprises a respective pivot for each of the centering elements, and wherein each of the pivots is disposed on the centering element between the interconnecting means and an end of the centering element adjacent the drilling axis.

26. A top head drive assembly for an earth drilling machine of the type comprising a load beam, means for guiding the load beam for movement along a mast, a quill supported on the load beam, and means for rotating the quill, wherein the load beam comprises:

a quill support member adapted to support the quill for rotation;

a box section disposed around said quill support member, said box section tapering in width from the quill support member to each end;

first and second diagonal braces disposed in the box section, each tapering in width from a wider upper end which abuts the quill support member to a narrower, lower end situated adjacent a lower portion of a respective one of the ends of the box section; and at least one pair of support elements, each positioned to surround the box section adjacent a respective end to resist any increase in width of the box section;

said braces positioned such that downward forces on the quill support member tend to increase the width of the box section adjacent the support elements.

27. The invention of claim 26 wherein the box section comprises:

a plurality of spaced, parallel upper and lower plates which increase in width from a narrower end adjacent the ends of the box section to a wider width adjacent the quill support member; and a plurality of side plates secured to the upper and lower plates to form the box section.

* * * * *